United States Patent [19]

Berger

[11] Patent Number: 4,720,258

[45] Date of Patent: Jan. 19, 1988

[54] TEMPERATURE CONTROL MEANS FOR EVAPORATORS

[76] Inventor: Hildegard Berger, Wannenweg 14, 6973 Boxberg, Fed. Rep. of Germany

[21] Appl. No.: 902,678

[22] Filed: Sep. 2, 1986

[30] Foreign Application Priority Data

Sep. 2, 1985 [DE] Fed. Rep. of Germany ..... 3531299
Jun. 23, 1986 [DE] Fed. Rep. of Germany ..... 3620956

[51] Int. Cl.[4] ..... F23D 11/44

[52] U.S. Cl. ..... 431/242; 431/208; 431/233

[58] Field of Search ..... 122/1 B, 448 S, 448 B, 122/18, 14, 4 A, 13 A; 236/1 B; 62/238.4; 431/233, 242, 208

[56] References Cited

U.S. PATENT DOCUMENTS 3,086,503 4/1963 Profos ..... 122/448 S
4,494,485 1/1985 Kendall et al. ..... 122/18 X

*Primary Examiner*—Edward G. Favors
*Attorney, Agent, or Firm*—Edwin E. Greigg

[57] ABSTRACT

The invention relates to a method and apparatuses for temperature control of a gas-heated evaporator according to DIN standard 30 696, which for attaining, keeping constant, and limiting a predetermined operating temperature is equipped with heating and control elements.

11 Claims, 1 Drawing Figure

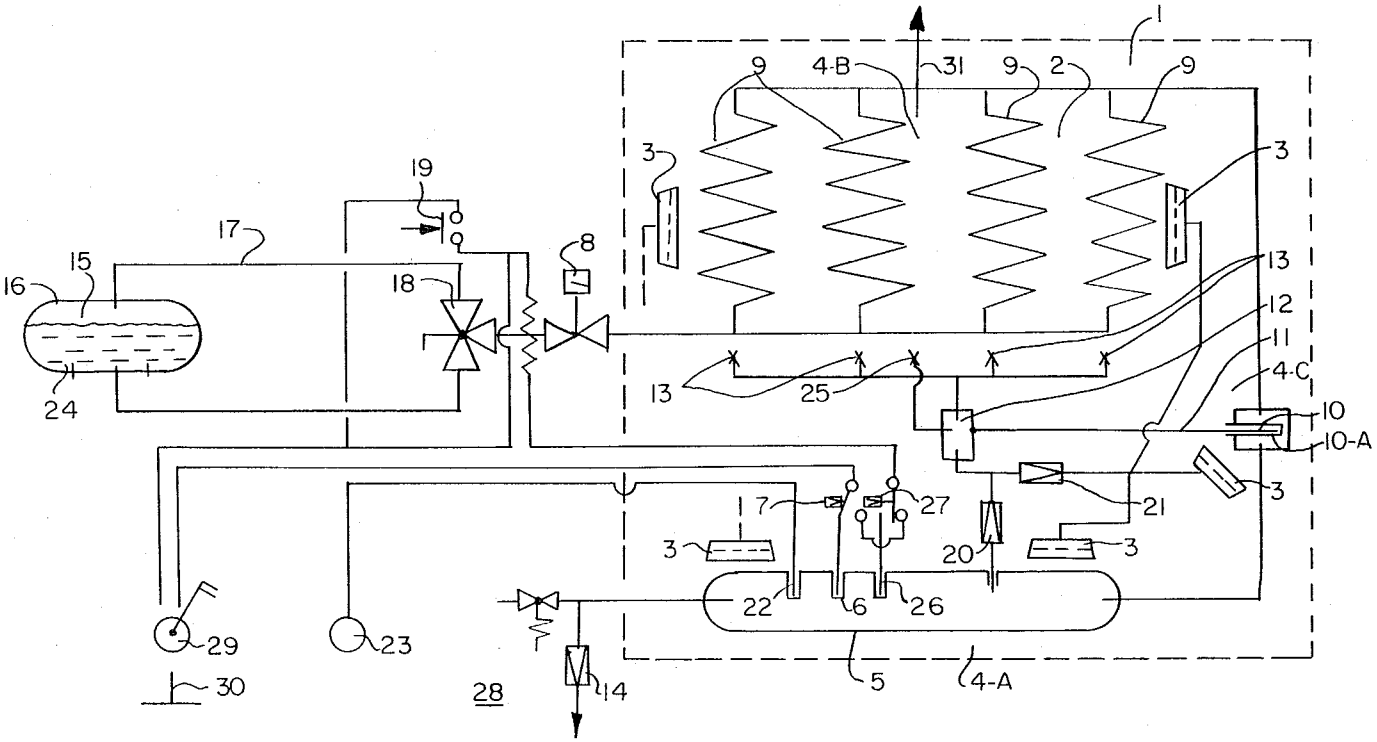
1
2
3
4-A
4-B
4-C
5
6
8
9
10
10-A
11
12
13
14
15
16
17
18
19
20
21
22
23
24
25
26
27
28
29
30
31

TEMPERATURE CONTROL MEANS FOR EVAPORATORS

BACKGROUND OF THE INVENTION

The present invention relates to an apparatus and a method for attaining, maintaining constant and limiting a predetermined operating temperature, preferably for a gas-heated liquid petroleum gas evaporator. According to DIN standard 30 696 for liquid petroleum gas evaporators, Section 3.5.3, evaporators must be so equipped and controlled that an exiting gas temperature of between 40° C. and 80° C. can be maintained. All that the DIN standard says about the temperatures arising in the interior of the evaporator is that a temperature limiter must be present, which either limits the temperature of a heat transfer medium to a maximum of 100° C., or prevents the exiting gas temperature from exceeding 90° C. Electrically heated evaporators are sometimes operated without the interposition of a heat transfer medium, and at the transitions between the heating device and the liquid petroleum gas (LPG) they often reach temperatures far above 100° C. In the American-made ALGAS and MITCHELL gas-heated evaporators, LPG-gilled pressure vessels are heated with a direct flame. Here, temperatures of up to approximately 500° C. can arise, while the exiting gas temperatures are at approximately 120° C. For these and other reasons, these apparatuses are not in accordance with DIN standard 30 696 and are not allowed in Europe.

According to Heinz Cordes in his work *Propan-Ratgeber* (*Propane Adviser*) published by the Strobel Verlag in Arnsberg, Federal Republic of Germany, oily deposits begin to be produced in the evaporation of LPG at temperatures of approximately 80° C. or above, which then soil the ensuing fixtures such as regulators, diaphragms, valves and so forth and make them sticky. At still higher temperatures, carbonization of the fuel sets in. For this reason, sediment traps and filter devices are typically provided following the evaporators.

German Pat. No. 3 307 520 describes an evaporator that operates with gas-heated coils—without a pressure vessel. According to European Patent Office Publication No. 0 126 852 A2 (Patent Journal 84/49 dated Jan. 14, 1985), the evaporator according to the above patent is additionally equipped with a means of electric preheating, with which the evaporator is initially preheated to the desired operating temperature without drawing fuel. In practice, it has now been found that the current required for the electric preheating is not always available, for instance in road construction machines and for heating points in railroad switches. Furthermore, the temperature control is too sluggish, and depending on the manner of operation and the fuel drawn at a given time, temperature fluctuations occur which may also be higher than the above-described limit. If current is cut off, which may be necessary on weekends to enable repair work to be done, the evaporator and the heating system connected to it shut down as well, which can cause considerable disruptions in operation.

OBJECT AND SUMMARY OF THE INVENTION

The invention seeks to overcome these problems. It is the object of the invention to make the evaporator independent of on-line power and to embody the temperature control such that operational readiness can be established and maintained in the temperature range prescribed by the DIN regulation, regardless of the mode of operation.

According to the invention, this object is attained in that an auxiliary gas- or electrically-operated accompanying heating system is installed in the evaporator heating chamber that is open to the atmosphere in such a way as to create zones of different temperature ranges in the heating chamber, thereby enabling useful cooperation between temperature sensors and regulating systems. With this novel temperature control, a gas-heated evaporator of the type corresponding to DIN 30 696 can be operated in the temperature range between 40° C. and 80° C. A particular advantage of this temperature control is that at an evaporator temperature of approximately 60° C., no harmful deposits whatever are produced, and so the installation of ensuing traps and filter devices can be dispensed with. A further advantage is that because of the low exiting gas temperature, recondensation of the fuel in the distribution network is prevented or made difficult. Substantial advantages also arise from the fact that the accompanying heating system can be supplied with energy from the gas phase of the fuel container. The evaporator thereby becomes independent of on-line power; the required control current can be drawn from a battery.

The invention will be better understood and further objects and advantages thereof will become more apparent from the ensuing detailed description of a preferred embodiment, given solely by way of example, taken in conjunction with the drawing.

BRIEF DESCRIPTION OF THE DRAWING

The sole drawing figure shows an exemplary embodiment of a temperature control for evaporators.

DESCRIPTION OF THE PREFERRED EMBODIMENT

According to the DIN regulation, in directly heated evaporators the fuel required for the evaporation must be in gaseous form and must have a pressure below 50 mbar. When the evaporator is put into operation, it is then possible to draw the fuel from the gas phase of a container and as it travels through the evaporator to ignite the burner and heat up the fuel. Upon attainment of the operating temperature, a switchover valve is switched over to the liquid phase, and the evaporator can be fully loaded. If there is a relatively long interruption in the drawing of gas, the evaporator cools down to below 40° C. Below 40° C., the safety valve switches the control current for the magnetic valve off and blocks the supply of fuel. Upon a renewed drawing of gas, putting the system into operation must be performed once again, as before, via the gas phase.

Alternatively:

Operational readiness is established by heating the heating chamber up to the required operating temperature by means of electric or gas heating until the liquid phase is switched on. This preheating and accompanying heating can also remain effective over the entire operating time, or can be switched on and off under thermostatic control, so that operational readiness is maintained even when no fuel is drawn for consumers for a relatively long time. A similar mode of operation will be described below in further detail.

The centerpiece of a gas-heated evaporator 1 is a useful cooperation of temperature sensors and regulating systems in various temperature zones. In the heating chamber 2 that is open to the atmosphere, heating elements—in this case, infrared radiators 3—are arranged such that zones of different temperatures, namely temperatures zones A, B and C, are created.

Temperature zone 4-A

The infrared radiator 3 that is effective at the control tube 5 is dimensioned such that a minimum temperature of 45° C. is reached and maintained. The temperature sensor 6 disposed in the control tube 5 controls the thermostat 7 via a capillary tube and at 40° C. closes the current circuit to the magnetic valve 8 and keeps that valve open.

Temperature zone 4-B

Here, infrared radiators 3 are disposed and dimensioned such that the coils of pipe 9 are heated to approximately 60° to 70° C. If the magnetic valve 8 is opened, fuel flows in via the coils 9 as far as the control tube 5. This fuel assumes the intended operating temperature of approximately 60° C.

Temperature zone 4-C

In this region, the infrared radiator 3 must be dimensioned such that during the preheating and intermediate heating period the temperature is in the range between 70° and 90° C. The temperature sensor 10, via a capillary tube 11, controls the automatic regulator 12, which permits the supply of fuel to the evaporation burners 13 only if the temperature at the temperature sensor 10 drops below 65° C. as a result of fuel withdrawal for gas consumers 14. This assures that the coils 9 cannot become overheated.

The energy required for the preheating or accompanying heating is drawn from the gas phase 15 of the container 16 and carried via the line 17 to the switchover valve 18. In the gas phase position, a touch contact switch 19 is actuated, which bridges over the current circuit that was interrupted by the thermostat 7 and opens the magnetic valve 8. The gaseous fuel now flows into the system of pipes as far as the inside of the control tube 5. Via the low-pressure regulator 20, the fuel reaches the adjustable multi-stage regulator 21 and the infrared radiators 3. These devices are ignited and heat the temperature zones 4-A, 4-B and 4-C provided in the heating chamber 1.

In the control tube 5, there is a further temperature sensor 22, which via a capillary tube indicates the temperature reached at the thermometer 23 and controls the heating elements 3 via built-in switch contacts, which are temperature-dependent in the usual manner.

After the set operating temperature is attained, the actuation of the switchover valve 18 effects the switch from the gas phase 15 to the liquid phase 24. After that, the ignition burner 25 that is supplied via the automatic regulator is ignited, and the evaporator can be operated with a changing load or a full load. Only if fuel is drawn off for gas consumers 14 and the gas temperature drops below 65° C. does the automatic regulator permit the supply of fuel to the evaporation burners 13 and ignite them by means of the ignition flame of the ignition burner 25. The automatic regulator 12 always supplies the evaporation burners 13 with only whatever amounts of energy are required for evaporating the fuel flowing through the system. If the ignition flame should go out, the thermoelectric ignition safety means, which is built into the automatic regulator, interrupts the supply of fuel to the evaporation burners 13 as well. The infrared radiators 3 supplied via the multi-stage regulator 21 continue to keep the evaporator 1 at the operating temperature. Only if overheating occurs in the heating chamber 2, for whatever reason, does the thermostat 27 controlled by the temperature sensor 26 interrupt the control current, which happens at 90° C. This closes the magnetic valve 8 and the evaporator 1 is shut down completely. If because of an overload too much fuel is withdrawn from the evaporator 1, the exiting gas temperature drops below 40° C., and the thermostat 7 switches the magnetic valve 8 off and puts the evaporator 1 out of operation. This assures that no liquid fuel can reach the gas consumers 14.

The evaporator 1 can be operated with control current 29 from a 12- or 24-volt battery or at 200 volts.

The foregoing relates to a preferred exemplary embodiment of the invention, it being understood that other variants and embodiments thereof are possible within the spirit and scope of the invention, the latter being defined by the appended claims.

What is claimed and desired to be secured by Letters Patent of the United States is:

1. An apparatus for attaining, keeping constant and limiting a predetermined operating temperature of an evaporator (1) accommodated in a heating chamber (2) open to the atmosphere, characterized in that heating elements (3) are positioned in predetermined relation in the heating chamber (2), said heating chamber (2) also being provided with a control tube, coils of pipe (9) for heat transmission and temperature sensor means (10), said last-named elements adapted to provide different temperature zone (4-A, 4-B, 4-C) whereby an ambient temperature is attained (reached and maintained) in the control tube (5) of over 40° C., another temperature is attained in proximity to the coils of pipe (9) of approximately 60° C., and still another temperature is attained in proximity to the temperature sensor (10) of over 65° C.

2. An apparatus as defined by claim 1, in which said temperature sensor (10) controls an automatic regulator (12) which regulates the evaporation burners (13) and accordingly supplies in a metered manner only that amount of energy required for evaporating the fuel flowing through the pipe coils (9), whereby the fuel temperature is maintained below 90° C.

3. An apparatus as defined by claim 1, in which said temperature sensor (10) and an immersion tube (10A) comprise a unit and are so arranged that temperature changes in the fuel flowing therethrough are transmitted without delays via a capillary tube (11) to the automatic regulator (12).

4. An apparatus as defined by claim 2, in which said temperature sensor (10) and an immersion tube (10A) comprise a unit and are so arranged that temperature changes in the fuel flowing therethrough are transmitted without delays via a capillary tube (11) to the automatic regulator (12).

5. An apparatus as defined by claim 1, in which said heating elements (3) are embodied by infrared radiators.

6. An apparatus as defined by claim 1, in which said heating elements (3) are embodied by gas burners.

7. An apparatus as defined by claim 1, in which said heating elements (3) are embodied by electric heaters.

8. An apparatus as defined by claim 1, in which the supply of energy to said heating elements (3) is controlled as a function of temperature via thermostats (7 and 27) and a magnetic valve 8.

9. An apparatus as defined by claim 5, in which the supply of energy to said heating elements (3) is controlled as a function of temperature via thermostats (7 and 27) and a magnetic valve 8.

10. An apparatus as defined by claim 1, in which said apparatus further includes a magnetic valve (8) and a thermostat (7) and a circuit of current thereby is closed only when the temperature at a temperature sensor (6) is at least 40° C. and further that a thermostat (27) interrupts this current circuit.

11. A method for attaining, keeping constant and limiting a predetermined operating temperature of an evaporator positioned in a heating chamber having a plurality of zones open to the atmosphere, comprising the steps of installing in the heating chamber a plurality of appropriately dimensioned heating elements, positioning each one of said plurality of heating elements in a separate one of said zones in said heating chamber to thereby control varying temperatures in each of said zones as well as to thereby provide an ambient temperature of a control tube (5) of over 40° C., another temperature of the coils of pipe (9) of approximately 60° C. and maintain still another temperature of the temperature sensor of over 65° C.

* * * * *